United States Patent [19]

Sheehan et al.

[11] Patent Number: 4,782,565

[45] **Date of Patent: * Nov. 8, 1988**

[54] AIR PROCESSING APPARATUS

[75] Inventors: Richard W. Sheehan, Johnson City; Kenneth A. Williford, Limestone, both of Tenn.

[73] Assignee: World Tech Fibres, Inc., Johnson City, Tenn.

[ * ] Notice: The portion of the term of this patent subsequent to Aug. 26, 2004 has been disclaimed.

[21] Appl. No.: 935,240

[22] Filed: Nov. 26, 1986

Related U.S. Application Data

[63] Continuation of Ser. No. 541,556, Oct. 13, 1983, Pat. No. 4,685,179.

[51] Int. Cl.[4] ..... D02G 1/16; D02J 1/06; D02J 1/08

[52] U.S. Cl. ..... 28/248; 28/252; 28/271; 28/274; 57/264

[58] Field of Search ..... 28/241, 242, 247, 248, 28/250, 251, 252, 271, 274, 275, 276, 290, 185; 57/264, 265, 100; 19/239, 240, 300; 34/54, 55

[56] References Cited

U.S. PATENT DOCUMENTS

| | | | |
|---|---|---|---|
| 2,852,906 | 9/1958 | Breen | 57/34 |
| 2,978,752 | 4/1961 | Cloutier et al. | 19/65 |
| 3,077,724 | 2/1963 | Stoddard et al. | 57/34 |
| 3,079,746 | 3/1963 | Field, Jr. | 57/51 |
| 3,775,955 | 12/1973 | Shah | 57/34 |
| 3,802,174 | 4/1974 | Landwehrkamp et al. | 57/5 |
| 3,823,541 | 7/1973 | Buzano | 57/144 |
| 3,852,946 | 12/1974 | Smith | 57/140 R |
| 3,854,313 | 12/1974 | Heichlinger et al. | 28/72.12 |
| 3,877,209 | 4/1975 | Seidl et al. | 57/34 |
| 4,019,310 | 4/1977 | Seidl et al. | 57/34 R |
| 4,038,811 | 8/1977 | Ansin et al. | 57/34 |
| 4,058,968 | 11/1977 | Benson | 57/140 |
| 4,096,687 | 6/1978 | McDonald | 57/157 F |
| 4,369,555 | 1/1983 | Nikkel | 28/221 |
| 4,570,312 | 2/1986 | Whitener, Jr. | 28/271 |

FOREIGN PATENT DOCUMENTS 1135384 11/1982 Canada .

*Primary Examiner*—Harvey C. Hornsby
*Assistant Examiner*—Joseph S. Machuga
*Attorney, Agent, or Firm*—Luedeka, Hodges & Neely

[57] ABSTRACT

An air processing apparatus is disclosed having a feed roll pulling yarn from a source and feeding it to an air entangler at a feed rate. The yarn is entangled by a high pressure air stream in the air entangler, and a delivery roll pulls the yarn from the entangler at a delivery rate. The rolls are driven independently and independent controls are provided to independently vary the feed rate and the delivery rate to achieve a desired overfeed or underfeed of the yarn. A display shows the ratio of the feed rate to the delivery rate. A slub making apparatus feeds yarn to the entangler from a second source of yarn and includes a tensioner for tensioning the yarn as it is fed to the air entangler. An actuator selectively releases tension on the yarn from the second source so that it is rapidly overfed and the air entangler produces a slub in the entangled yarn.

5 Claims, 5 Drawing Sheets

AIR PROCESSING APPARATUS

This application is a continuation application of U.S. Ser. No. 06/541,556, filed Oct. 13, 1983 now U.S. Pat. No. 4,685,179.

The present invention relates to air entangling processors for yarn and particularly relates to an air entangling processor having independently driven and controlled feed, delivery and wind rolls.

In the manufacture of yarn, it is often desirable to air entangle the fibers of one or more yarn threads. The desired entanglement may be accomplished by passing the yarn through a nozzle with one or more jets of high pressure air directed against the yarn to entangle it. In a common type of air entangling apparatus, the yarn is fed to the air nozzle by a roll known as a feed roll and the yarn is pulled from the nozzle by a roll known as a delivery roll.

In the past, the delivery roll and the feed roll have been mechanically interconnected by pulleys, chains and the like, so that they are rotated in synchronism or so that a constant relationship exists between the delivery roll speed and the feed roll speed.

One disadvantage of this type of conventional machine is that it is difficult and cumbersome to change the relationship between the speed of the feed roll and the speed of the delivery roll. In order to change the speed of one of the rolls relative to the other, it was necessary to change chain sprockets or pulleys. In the present invention, provision is made for easily changing the speed relationships between the feed roll and the delivery roll.

In accordance with one form of the present invention, an air processing apparatus for air entangling yarn includes at least one feed roll for engaging and pulling the yarn from a source and feeding the yarn at a feed rate. A feed motive means rotatably drives the feed roll, and an air entangler apparatus receives the yarn from the feed roll and entangles it with a high pressure air stream. A delivery roll engages and pulls the yarn from the air entangler apparatus at a delivery rate, and a delivery motive mechanism rotatably drives the delivery roll independently from the feed roll. A control is provided for independently controlling the feed motive mechanism and the delivery motive mechanism to independently vary the feed rate and the delivery rate of the yarn. Thus, a selected feed rate and a selected delivery rate may be chosen to achieve the desired overfeed or underfeed condition to produce a desired effect on the yarn and to achieve a desired production rate.

The ability to control the speed of the delivery roll and the feed roll independently from one another offers a significant advantage in air processing yarn. Often, it is necessary to provide a precise amount of overfeed in order to achieve a desirable entanglement for a particular type of yarn. Overfeed is the amount by which the feed rate exceeds the delivery rate. For example, a five percent overfeed would mena that the feed rate was five percent greater than the delivery rate. In many cases, too much overfeed or too little overfeed will result in an undesirable yarn entanglement, and it is necessary to precisely control the amount of overfeed. In the present invention, the ability to independently set both the feed rate and the delivery rate allows the user to very precisely control the amount of overfeed.

It is also possible to select a negative overfeed. That is, the feed rate may be set lower than the delivery rate.

In such case, the yarn must stretch in order to allow the delivery rate to be greater than the feed rate. In order to have a negative overfeed, generally, one must be using a yarn that is not fully oriented, and such yarn is referred to as a partially oriented yarn. Some partially oriented yarn will stretch to as much as four times its lenght, but generally the negative overfeed (the underfeed) will be about no more than fifty percent (50%). Thus, a typical practical range for overfeed is about from −50% to +125%. In order to properly entangle fully oriented yarn (yarn that will not stretch) it is generally necessary to provide overfeed.

In accordance with another aspect of the present invention, a display panel displays information about the feed rate and the delivery rate. Usually, the display shows the ratio between the feed rate and the delivery rate which corresponds to the overfeed ratio.

In accordance with another aspect of the present invention, the apparatus may also include a wind roll for engaging and pulling the yarn from the delivery roll at a wind rate, and a wind motive mechanism for rotatably driving the wind roll independently from feed and delivery rolls. A control is also provided to independently control the wind motive mechanism to idependently vary the wind rate. Thus, the wind rate may be chosen relative to the delivery rate to achieve a desired overdelivery or underdelivery and produce a desired effect on the yarn. In the case of underdelivery, the yarn will be wound tightly on the spool and will be stretched. In the case of overdelivery, the yarn will be wrapped loosely on the spool.

In accordance with another aspect of the present invention, the feed motive mechanism, delivery mechanism and control are respectively: a feed motor, a delivery motor and motor controllers. The motor controllers include an acceleration/deceleration circuit that smoothly accelerates and decelerates the motors. In the preferred embodiment, the acceleration/deceleration circuit produces a linear ramp signal that is used to accelerate and decelerate the motors at a constant linear rate of acceleration or deceleration. It is important to have a smooth start of the motors so that the yarn will not be snapped by a jerking action. A conventional motor starter that used a capacitive delay would attempt to start the motor with a theoretical infinite acceleration and would cause the motor to jerk and perhaps break the yarn. Also, it is important to smoothly decelerate the motors in order to produce a good product during shut down.

In accordance with another form of the present invention, a slub making apparatus produces a slub in the air entangled yarn. The apparatus in this form includes a first source of yarn, and a feed roll for pulling the yarn from the first source and feeding it at a feed rate to an air entangler station. The yarn is entangled at the air entangler station and is pulled therefrom by a delivery roll. A second source of yarn is provided which is fed along a feed path from the second source to the air entangler where the yarn from the first and second sources are air entangled. A tensioner is disposed along the feed path to engage the yarn from the second source and yieldably resist the movement of the yarn from the second source to the air entangler station with a selected resistance force so that a selected tension is placed between the tensioner and the air entangling station. An actuator is attached to the tensioner and selectively actuates and de-actuates the tensioner from the yarn. When the yarn from the second source is released from tension, it is rapidly overfed to the air entangler. A slub is produced in the entangled yarn. A slub is a loop of yarn the projects outwardly, somewhat obliquely, from the main body of the yarn. In the preferred embodiment, a random pulse generator is used to randomly cause the tensioner to release the yarn from the second source to, thereby, randomly produce the slubs.

By a combination of the above described psuedo making apparatus with the independently psuedo random controllable feed and delivery rolls and the display, it is possible to precisely set and display the feed roll speed, the delivery roll speed and the ratio of the two speeds. Thus, the operator may set the speed of both rolls according to the type of yarn that is being processed and the type of yarn being used to produce the slub. If known, the operator may set the roll speeds to achieve a desired entanglement and to maximize production, or the operator may easily vary the roll speeds to empirically determine the appropriate speeds to achieve the desired entanglement and production.

The present invention may best be understood by reference to the following Detailed Description of a preferred embodiment when considered in conjunction with the Drawings in which.

Figure 1:
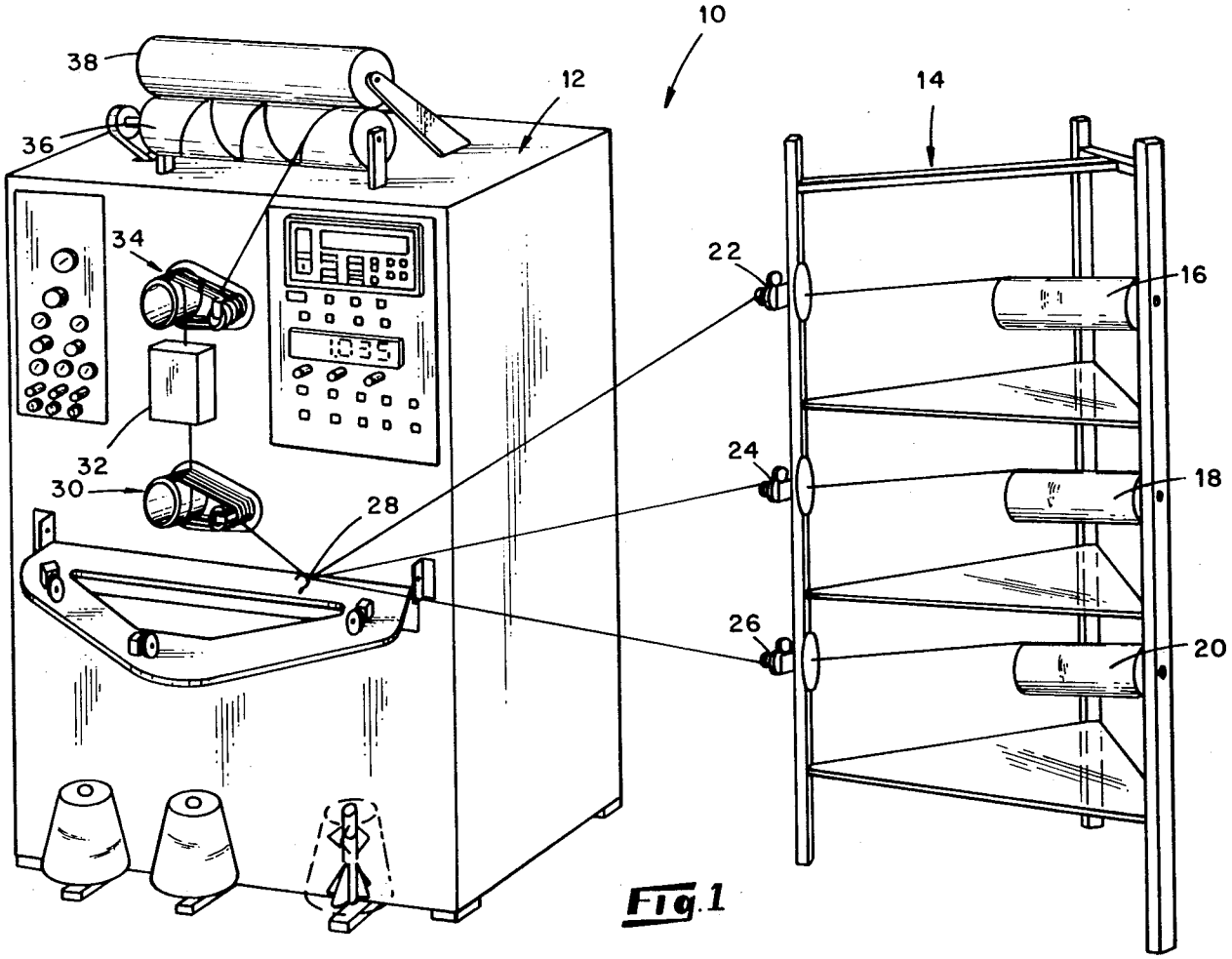
FIG. 1 is a perspective view of the air entangling apparatus of the present invention.

Referring now to the FIGURES in which like reference characters designate like or corresponding parts throughout the several views, there is shown in FIG. 1 an air processor for entangling yarn which includes a yarn handling and processing station 12 and creel 14. Three spools of yarn 16, 18 and 20 are mounted on the creel 14 and they feed yarn through tensioners 22, 24 and 26, respectively, to the yarn handling and entangling station 12.

A guide 28 is mounted on station 12 slightly below the feed roll 30 and receives the yarn from the tensioners 22, 24 and 26. All three strands of yarn pass through the single guide 28 and travel in a side-by-side relationship to the feed roll 30. For traction, the yarn is wrapped about the feed roll 30 a plurality of times, preferably six, in tracks or grooves formed on the feed roll 30.

The feed roll 30 feeds the yarn to an air processing chamber 32 where the yarn is air entangled. The air entangling chamber 32 is preferably the type of air processor that includes a nozzle that directs one or more jets of air obliquely into the side of the yarn to create entanglement.

Figure 9:
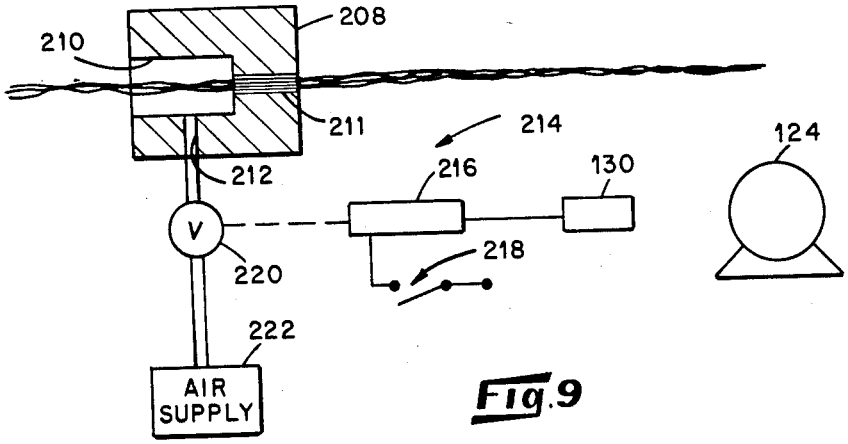
FIG. 9 is a diagrammatical view of an air entangling nozzle and air supply control system.

Referring to FIG. 9, the air entangling chamber 32 includes a nozzle 208 that receives the yarns to be entangled and has two apertures 210 and 211, one larger than the other. The yarn enters the nozzle 208 through the large aperture 210 and a blast of air delivered through a port 212 in the walls of the aperture 210 entangles the yarn. The entangled yarn then passes through the smaller aperture 211 on its way to the delivery roll 34.

The air entangling process is regulated by a circuit 214 also illustrated in FIG. 9. The circuit 214 comprises an actuator 216, a switch 218, and the sensor 130 which regulate a valve 220. When the switch 218 is closed, it turns the actuator 216 "on". When the sensor 130 produces a signal indicating that the wind motor 124 is operating, assuming the actuator 212 is turned on, it will actuate valve 220 to an open position. An air supply 222 is connected through the valve 220 to the port 212 of nozzle 208. When the valve 220 is open, the nozzle 208 receives high pressure air from the supply 222.

If the switch 216 is not closed or if the sensor 130 is not producing a signal indicating that the wind motor 124 is operating, then the valve 218 will close or remain closed and the air supply 222 is cut off from the nozzle 208.

Referring again to FIG. 1 a delivery roll 34 is positioned above the air entangling chamber 32 and pulls the yarn from the chamber. The delivery roll 34 is similar to the feed roll 30 and functions to pull the yarn from the chamber 32 and deliver it to a wind roll 36. The wind roll 36 is conventional in design and winds the yarn onto a spool 38.

The type of feed roll 30 and delivery roll 34 is not critical to the invention, but in the preferred embodiment, these rolls actually comprise a large driven roll 64 and a smaller passive roll 66 that are positioned in a parallel, spaced apart relationship. The yarn is wound around and passes between the large driven roll 64 and the passive roll 66. This structure is best shown and described hereinafter in reference to FIG. 2.

Figure 2:
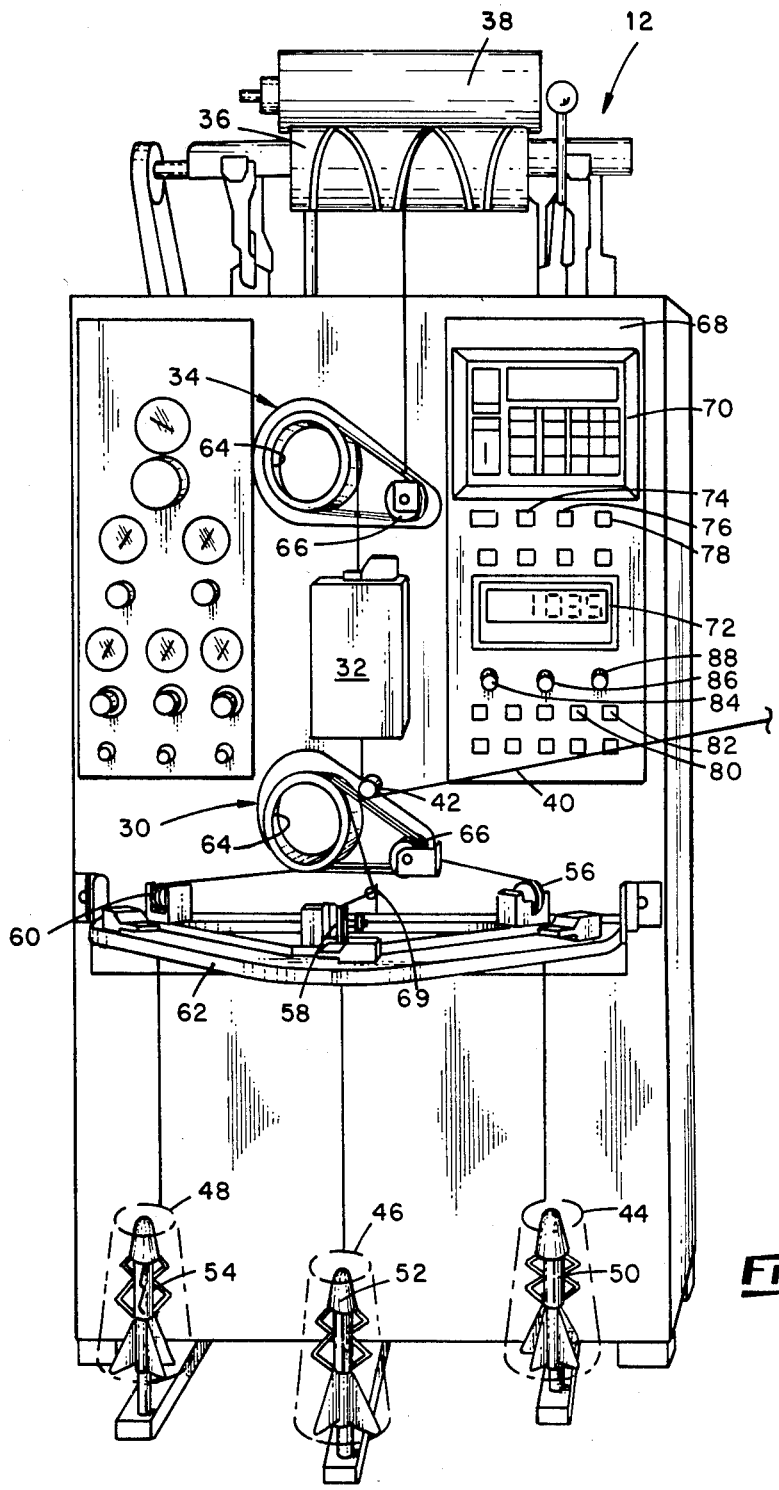
FIG. 2 is a front view of a portion of the air entangling apparatus showing the feed roll, the air entangler, the delivery roll and the wind roll.

In FIG. 2, there is shown a front view of the station 12 with a different yarn arrangement from FIG. 1. In this view, the yarn is fed to the station 12 from three yarn cones, 44, 46 and 48, which are mounted on spindles 50, 52 and 54, respectively. Tensioners 56, 58 and 60 are mounted on a frame 62 adjacent to the front face of the station 12. The tensioners 56, 58 and 60 receive the yarn from the cones 44, 46 and 48, tension the yarn, and guide the yarn toward the feed roll 30.

The feed roll 30 actually comprises a large driven roll 64 and a passive roll 66 that are mounted in a side-by-side, spaced apart, parallel relationship. The yarn from tensioner 60 is fed directly onto the driven roll 64. The yarn from the tensioner 58 is fed through a guide 69 and then to the driven roll 64. The yarn from the tensioner 56 is fed onto the passive roll 66 and from there to the driven roll 64. The three strands of yarn are combined or placed side-by-side on the driven roll 64 and then the yarn is wrapped six times between the driven roll 64 and the passive rolls 66. The yarn leaves the driven roll 64 and passes directly into the air entangling chamber 32.

A separate strand of yarn 40 is fed through a tensioner 22 on the creel 14 as shown in FIG. 1, and passes around a passive guide pulley 42. This separate strand of yarn 40 is then fed directly into the air entangling chamber 32. Inside the chamber 32, the yarn strands fed from cones 44, 46 and 48 and the separate strand 40 are air entangled by a jet of high pressure air. After the yarn is entangled, it passes to the delivery roll 34 which is substantially identical to the feed roll 30 and includes a driven roll 64 and a passive roll 66. Again, the yarn is wrapped about the delivery roll 34 approximately six times and then is directed to the wind roll 36 which is a driven roll that winds the yarn onto the spool 38. It will be noted that the wind roll 36 drives the spool 38 at its circumference. Thus, the wind roll 36 will be rotating at a constant speed and pulling the yarn from the delivery roll 34 at a constant speed, but the spool 38 will be rotating at a decreasing rotational speed as its circumference grows.

A control board 68 is mounted on the right side of the entangling station 12. The board 68 includes a display 70 for displaying actual speeds of the various rolls and a display 72 for displaying speed ratios between the rolls. Immediately below the display 70 there are three buttons 74, 76 and 78. When button 74 is depressed, display 70 will show the actual speed of the feed roll 30 in feet per minute. When button 76 is depressed, the speed of the delivery roll 34 is displayed and when button 78 is depressed the speed of the wind roll 36 is displayed.

Below the display 72, there are two buttons 80 and 82. When button 80 is depressed, display 72 shows the ratio of the speed of feed roll 30 divided by the speed of the delivery roll 34. Thus, when button 80 is depressed the overfeed or underfeed of the station 12 is displayed by display 72 as a ratio. For example, 1.03 would indicate a three percent overfeed and 0.97 would indicate a negative three percent overfeed (or a three percent underfeed).

When button 82 is depressed, there is shown on display 72 a ratio between the speed of the wind roll 36 divided by the speed of the delivery roll 34. Thus, when button 82 is depressed, the ratio displayed corresponds to the amount of overdelivery or underdelivery. A ratio of 1.03 would indicate that the wind roll 36 is operating at a higher speed than the delivery roll 34 and, thus, would indicate an overdelivery of negative three percent. When the display indicates a ratio of 0.97 it indicates that the delivery roll 34 is operating at a higher speed than the wind roll 36 and, thus, would indicate an overdelivery of three percent.

Also, immediately below the display 72, there are three knobs 84, 86 and 88 that may be rotated to vary the speed of the feed roll 30, the delivery roll 34 and the wind roll 36.

In operation, before any yarn is placed on the station 12, the knobs 84, 86 and 88 may be used to set the speed of the rolls at a desired level. Knob 84 controls the speed of the feed roll 30, knob 86 controls the speed of the delivery roll 34, and knob 88 controls the speed of the wind roll 36. To begin operation, the machine may be turned on and the desired speed of the feed roll 30 is set with knob 84. The speed of the roll 30 is checked by using display 70 with button 74 depressed.

After the speed of feed roll 30 has been set, button 80 is depressed to display the overfeed ratio on display 72. Using knob 86, the speed of the delivery roll 34 is set to achieve a desired overfeed by reference to the display 72. The actual speed of the delivery roll 34 may be checked by depressing button 76 and referring to display 70.

After setting the speed of the delivery roll 34, the speed of the wind roll 36 is set by depressing button 82 and using knob 88 to adjust the speed of the wind roll 36 until a desired overdelivery or underdelivery condition is achieved. The overdelivery or underdelivery ratio is displayed on display 72 during this adjustment process. To check the actual speed of the wind roll 36, button 78 may be depressed and the speed of the wind roll 36 will be displayed on display 70.

Once the speed of the various rolls is set, the yarn may be placed on the rolls and through the entangler chamber 32 as previously described. Then the machine is started. As will be hereinafter described in greater detail, the motors that drive the rolls 30, 34 and 36 are controlled to start with a smooth acceleration, preferably a smooth, constant, linear acceleration so that there is no jerking action and no breaking of the yarn. Also, the motors are controlled to decelerate the rolls 30, 34 and 36 in a smooth constant linear deceleration. In this manner, the yarn is air processed and good product is produced during deceleration.

After the yarn processing process has begun and the motors driving the rolls 30, 34 and 36 are operating at the selected speeds, the speed of the rolls 30, 34 and 36 may be adjusted using knobs 84, 86 and 88 and displays 70 and 72 in the manner previously described.

The display 72 is a Red Line, Model 620 and display 70 is a Veeder-Root Counter 7931. Both displays 70 and 72 are connected to sensors 130, 132 and 134 shown in FIG. 3. While it is believed novel to provide the display combination and functions described above, the actual displays 70 and 72 are standard displays.

Figure 3:
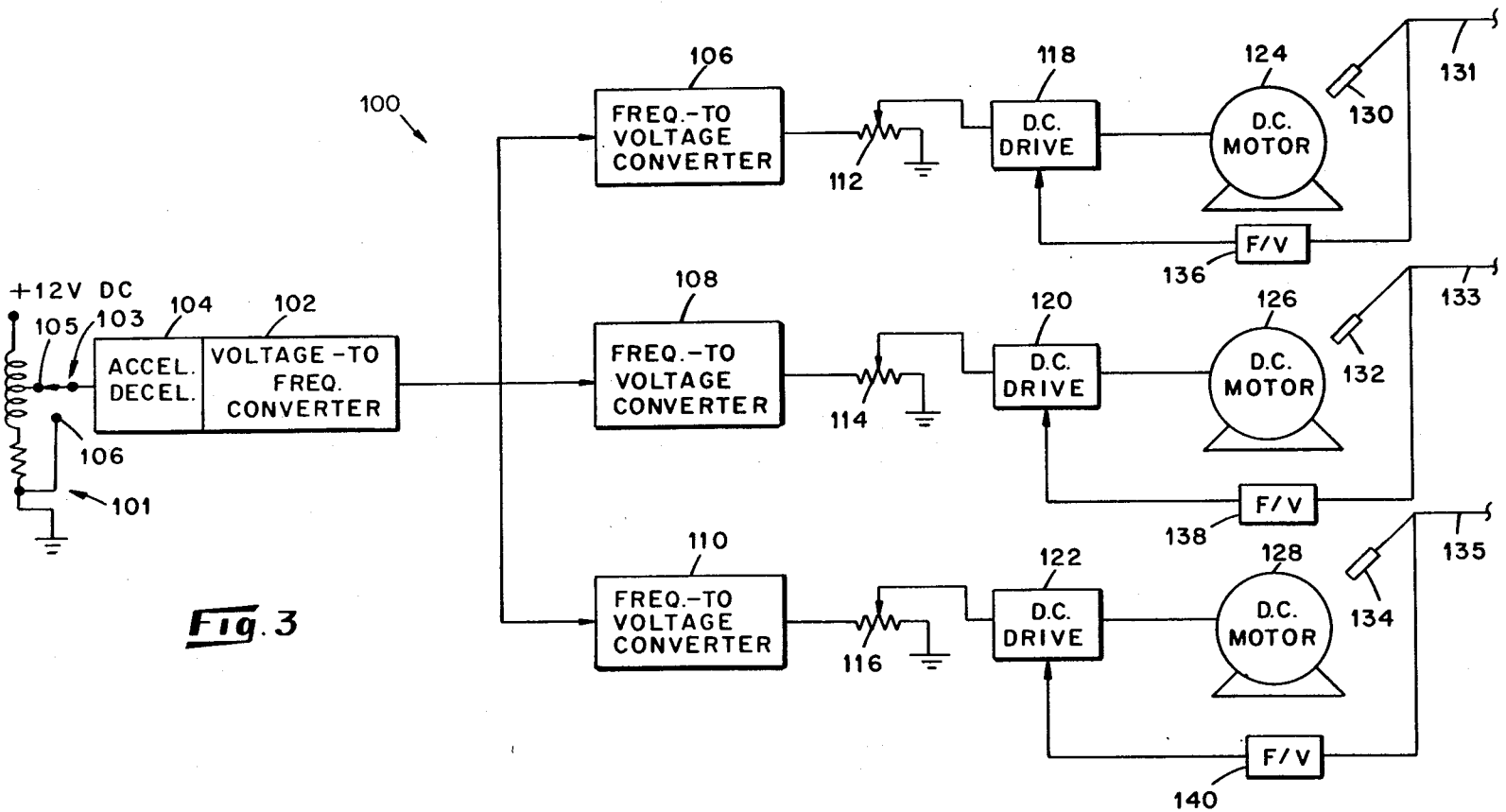
FIG. 3 is a block diagram of the electrical circuit that controls the DC motors that drive the feed roll, the delivery roll and the wind roll.

In FIG. 3, there is shown a circuit 100 that is used to control the speed of the motors driving the feed roll 30, the delivery roll 34, and the wind roll 36. Initially, a fixed accurate voltage is obtained from a voltage source 101. The voltage source 101 includes a switch 103 that is switchable from a first to a second control voltage between node 105, the "on" position, and node 106, the "off" position. In the "on" position, the switch receives the first control voltage a precise 5.2 voltage, from a 12V power supply through a resistance/inductance circuit. In the "off" position, the switch receives the second control voltage, a 0.0 voltage, and is connected to ground. The signal from the voltage source 101 is connected by switch 103 to a voltage-to-frequency convertor 102 that includes an acceleration/deceleration circuit 104. The voltage-to-frequency convertor 102 is manufactured by Safetronics as Model No. CA220. The acceleration/deceleration circuit 104 produces a linear ramp signal which is fed to the voltage-to-frequency convertor portion of the convertor 102. When the motors are turned on and the voltage jumps from zero to 5.62 volts, the circuit 104 produces a linear ramp that goes up from zero volts to 5.62 volts. When the motors are turned off and the voltage from the source 101 drops to zero volts, the acceleration/deceleration circuit 104 again produces a linear ramp going down from 5.62 volts to zero volts.

The convertor 102 produces a frequency signal that corresponds to the voltage it receives from the circuit 104. Thus, after the motors are started, the voltage-to-frequency convertor 102 produces a frequency corresponding in magnitude to 5.62 volts. This frequency signal is fed from convertor 102 to frequency-to-voltage convertors 106, 108 and 110 which are identical and are manufactured by Safetronics, Model No. CA133. The output of the convertors 106, 108 and 110 is a voltage corresponding in magnitude to the magnitude of the frequency signal received from the convertor 102 and these voltages are applied, respectively, to potentiometers 112, 114 and 116. The potentiometers 112, 114 and 116 are controlled, respectively, by knobs 84, 86 and 88 to vary, respectively, the speeds of the wind roll 36, the delivery roll 34 and the feed roll 30. The potentiometers 112, 114 and 116 are operable to produce a variably reduced voltage which is applied to DC drives 118, 120 and 122 which are identical DC drives manufactured by Safetronics, Model No. DG2.

The DC drives 118, 120 and 122 control the speed of motors 124, 126 and 128 in accordance with the variable voltage received from the potentiometers 112, 114 and 116. The motors 124, 126 and 128 drive, respectively, the wind roll 36, the delivery roll 34 and the feed roll 30. Sensors 130, 132 and 134 are provided for sensing the speed of the DC motors 124, 126 and 128. These sensors may be any of a number of conventional sensors for detecting the speed of motors, but in the preferred embodiement, a notched disk is placed on the motor and a proximity sensor is used to detect passing of the notches. Thus, by counting the frequency of passing notches, the speed of the motors may be determined. The sensors 130, 132 and 134 provide a signal through lines 131, 133 and 135, respectively, to the control board 68 shown in FIG. 2 and provide to the control board 68 the speed of the motors 124, 126 and 128 and consequently the speed of the wind roll 36, the delivery roll 34 and the feed roll 30. Using this information, the control board 68 is operable to display the various speeds and speed ratios as previously described.

Also, the output of the sensors 130, 132 and 134 are fed back into a feedback loop through frequency-to-voltage convertors 136, 138 and 140, respectively, to the DC drives 118, 120 and 122. In this manner, the feedback loop corrects the speed of the DC motor if the load on the motor tends to slow it.

The primary advantage of the circuit 100 is that the voltage-to-frequency convertor 102 and the frequency-to-voltage convertors 106, 108 and 110 isolate the fixed accurate voltage source 101 from the motors 124, 126 and 128 and from the DC drives 118, 120 and 122. Also, the frequency to voltage convertors 106, 108 and 110 isolate the DC drives 118, 120 and 122, one from the other. Thus, the voltages that are used to control the three DC motors will not interfere with one another. There may be some voltage fluctuation on the lines between the voltage-to-frequency convertor 102 and the frequency-to-voltage convertors 106, 108 and 110, but these voltage variations will not effect the frequency of the signals and, thus, the accurate control of the motors is maintained even though there is some voltage fluctuation and feed back.

The two linear ramps produced by the acceleration/deceleration circuit 104 function to start and stop the motors at a smooth constant rate of acceleration and deceleration. As previously described, this function is advantageous in that it allows for a smooth startup that will not break the yarn and provides for a smooth shut down so that a useful product is produced even during deceleration.

Figure 4:
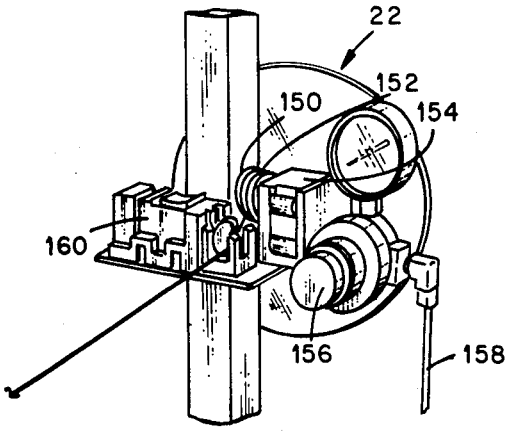
FIG. 4 is a perspective view of a tensioner used in the slub making apparatus.
Figure 5:
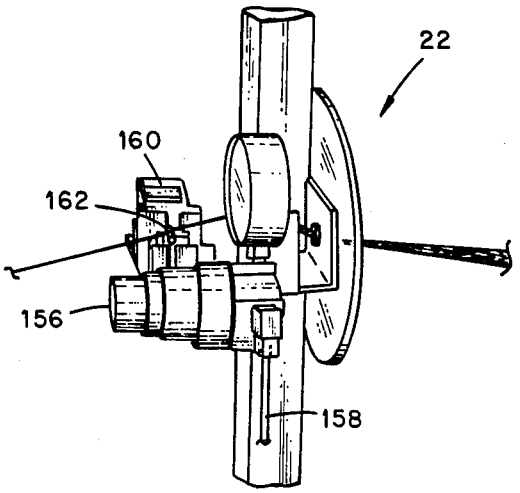
FIG. 5 is a side-view of the tensioner.

Referring now to FIGS. 4 and 5, there is shown two views of the tensioners, such as tensioner 22 or tensioner 56 used in the present invention. In reference to FIGS. 4 and 5, the tensioners will be referred to using the character 22.

As part of the tensioners 22, a pair of metal disks 150 and 152 are mounted in a side-by-side opposed relationship. The yarn passes between these disks and is frictionally engaged by the disks to create the desired tension. The disk 150 is mounted in a stationary position relative to the tensioner and the disk 152. The disk 152 is mounted on a piston and is operable to be reciprocatively moved toward and away from the disk 150 to apply pressure to the yarn therebetween. The piston is part of the piston and cylinder set 154 which is driven by air pressure. When air pressure is present, the piston is urged outwardly and it urges disk 152 toward disk 150. When the air pressure is released, the pressure on the disk 152 is released. The piston and cylinder set 154 receives its air supply through a valve and gauge 156. The air pressure supply to the piston and cylinder set 154 is adjusted using the valve and gauge 156 and, thus, the tension applied to the yarn that extends between the disks 150 and 152 may be adjusted by adjusting the setting of the valve and gauge 156. Air is supplied to the valve and gauge 156 by an air supply line 158.

The tensioner also includes a micro switch 160 having a switch lever arm 162. When the yarn is under tension and the machine is operating, the micro switch lever arm 162 is held down indicating that a thread is present. If the thread breaks, i.e., the thread is lost, the micro switch arm 162 will move upwardly to the position shown in FIG. 5. Thus, the micro switch 160 is used to indicate the presence or absence of a thread and the output of the micro switch 160 may be used to turn the machine off when a thread is lost.

Figure 6:
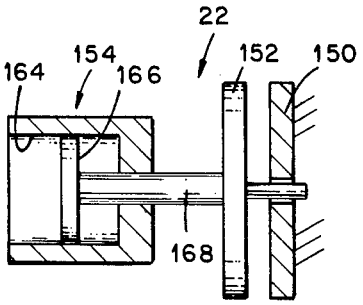
FIG. 6 is a diagrammatical side cross-sectional view of a piston and cylinder set used in the tensioner.

Referring now to FIG. 6, there is shown a somewhat diagrammatical partial view of the piston and cylinder set 154 which includes a cylinder 164 with a piston 166 mounted therein. A piston rod 168 extends outwardly from the piston 166 through an aperture in the cylinder 164, and the end of the rod 168 is attached to the approximate center of the disk 152. The other disk 150 is fixedly mounted and the disk 152 is forced toward and away from the disk 152 in order to apply tension to yarn passing between the disks 150 and 152 in the manner previously described.

Figure 7:
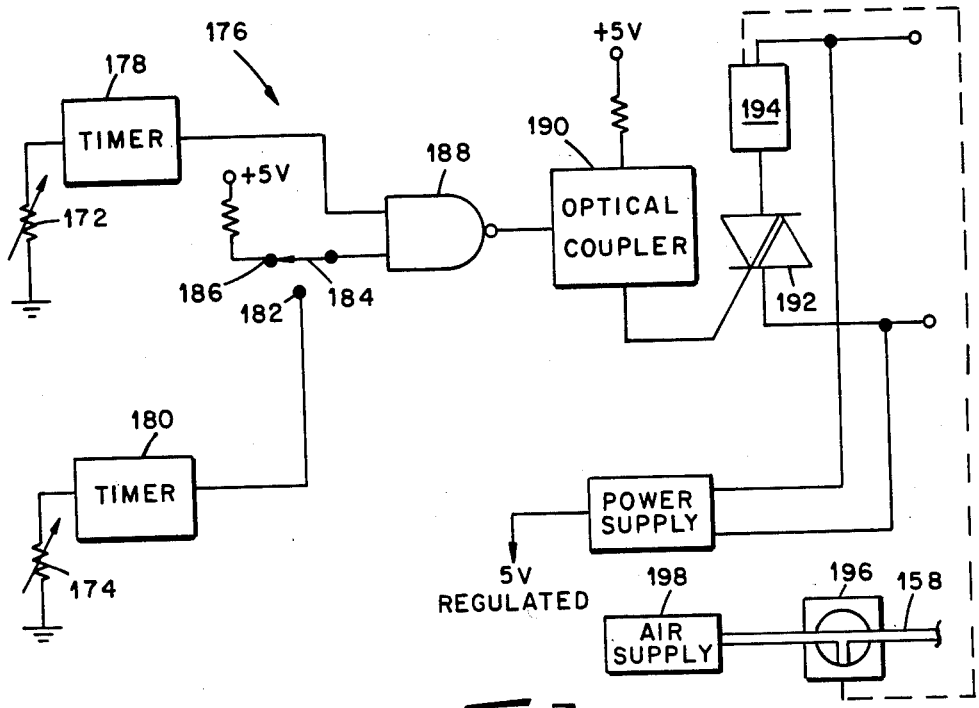
FIG. 7 is an electrical diagram of a psuedo random pulse generator used to actuate the tensioner.

Referring now to FIG. 7, there is shown a psuedo random pulse generator circuit 176 for controlling the air supply to the tensioner 22. The circuit 176 includes two timers 178 and 180 that generate clock pulses at a frequency controlled, respectively, by the variable resistors 172 and 174. The pulses from the timer 180 are applied to a node 182 of a switch 184. Another node 186 of the switch 184 is connected to a five volt power supply and the switch 184 is connected as one input to an NAND gate 188. The other input to the NAND gate 188 is the output of the timer 178. When the switch 184 is connected to the node 186, the output of the NAND gate 188 is identical to the output of the timer 178 and is connected through an optical coupler 190 to a silicon control switch 192 which switches a solenoid 194 on and off. The solenoid 194 is mechanically connected to a valve 196 which is interposed in an air line 158 that extends between lan air supply 198 and the valve 156 shown in FIGS. 4 and 5.

When the switch 184 is connected to node 186 as shown in FIG. 7, the output of the NAND gate 188 is identical to the output of the timer 178 and a constant train of timing pulses are transmitted through the optical coupler 190 to the switch 192. This causes the solenoid 194 to uniformly switch the valve 156 between the position shown in FIG. 7 in which the air supply 198 is connected to the line 158 and a position where the line 158 is vented to the atmosphere.

When the switch 184 is connected to the node 182, the NAND gate 188 receives two different timing signals at its inputs. Thus, the output of the NAND gate 188 is not uniform and is, instead, a psuedo random train of pulses that are applied through the optical coupler 190 to the switch 192. In this configuration, the switch 192, will psuedo randomly switch the solenoid 194 which will randomly switch the valve 196 between the position supplying pressurized air to line 158 and the position venting line 158 to atmosphere.

Referring again to FIGS. 4 and 5, when pressurized air is supplied to line 158, the disks 150 and 152 are forced together and the tensioner 22 will apply tension to the yarn. When line 158 is vented to atmosphere, disks 150 and 152 are not urged together and the tensioner 22 will release most of the tension from the yarn passing between the disks 150 and 152.

Figure 8:
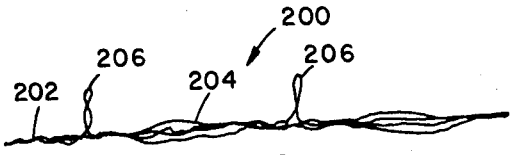
FIG. 8 is a view of entangled yarn with a slub.

Referring again to the FIGS. 2, 4, 5 and 7, it will be appreciated that slubs may be produced in the yarn by selectively releasing the tension on yarn strand 40. When the yarn is moving through the chamber 32, it is entangled with the other strands of yarn within the chamber and the delivery roll 34 is pulling all the yarn, including yarn 40, out of the entangling chamber 32. A combination of forces are operating on the yarn strand 40 to pull it into the chamber 32. First, the delivery roll 34 is directly pulling the yarn 40 through the chamber 32. Also, once the yarn strand 40 becomes entangled with the other yarn, the movement of the other yarn will tend to pull strand 40 through the air entangling chamber 32. Finally, there is a blast of air applied to the yarn 40 in a oblique or perpendicular direction as it moves through the chamber 32. This blast of air will entangle the yarn 40 and it will also tend to move the yarn 40 laterally out of its path, and the tension on the yarn 40 resists the lateral movement due to the high pressure air stream. When the tension is suddenly removed from yarn strand 40, there is little or no resistance to this lateral movement and yarn strand 40 is blown laterally with respect to the other yarn passing through the chamber 32 and is rapidly overfed to the chamber. When the tension is reapplied, the air entangling process begins again, and the yarn strand 40 is air entangled with the other yarn passing through the chamber 32. The above described process forms a loop of yarn strand 40 extending laterally from the side of the other yarn strands. This loop is herein referred to as a slub. In FIG. 8, there is shown a air entangled portion of yarn 200 having air entangled portions 202 and non-entangled portions 204. Projecting laterally from the yarn 200 are two slubs 206 that were produced in the manner described above.

Although a particular embodiment of the present invention is described herein, it will be understood that the invention is capable of numerous modifications, rearrangements and substitutions of parts without departing from the spirit of the invention. In particular, it will be understood that while the present invention uses DC motors and a DC control system, it would be possible to use other drive systems to obtain the independent operation of the various rolls of the present invention.

What is claimed is:

1. An air processing apparatus for air entangling at least one strand of yarn from a source comprising:

an air entangler for receiving the strands of yarn from the source and entangling the strands of yarn with a high pressure air stream;

at least one delivery roll for engaging and pulling the entangled yarn from said air entangler at a delivery rate;

delivery motive means for rotatably driving said delivery roll independently;

at least one wind roll for engaging and pulling the entangled yarn at a wind rate from said delivery roll;

wind motive means for rotatably driving said wind roll independently from said delivery roll;

a delivery rate sensor for monitoring the delivery rate of said delivery roll;

a wind rate sensor for monitoring the wind rate of said wind roll;

output means responsive to said sensors for selectively outputting speed information of the delivery rate and the wind rate;

control means for independently controlling said wind motive means and said delivery motive means to independently vary the wind rate and the delivery rate of the yarn, and thus the speed information, whereby a selected wind rate and a selected delivery rate may be chosen based on the speed information to achieve a desired overdelivery or underdelivery to produce a desired effect on the yarn and to achieve a desired production rate.

2. A processing apparatus for processing yarn from a source comprising:

at least one first roll for engaging and pulling the yarn from the source;

a first motor for rotatably driving said first roll;

a yarn processor for receiving and processing the yarn to produce a desired effect;

a second roll for engaging and pulling the yarn at a second rate;

an acceleration/deceleration circuit for producing a linear ramp signal linearly varying between first and second voltages;

switch means for actuating the acceleration/deceleration circuit to switch between producing the first voltage and the second voltage;

voltage to frequency converter means for receiving the linear ramp signal and producing a control frequency at a frequency corresponding to the voltage of the linear ramp signal;

frequency to voltage converter means for receiving the control frequency and for producing at least one control voltage corresponding to said control frequency;

first motor control means for receiving at least one control voltage for controlling the speed of said first motor;

second motor control means for receiving at least one control voltage for controlling the speed of said second motor independently of the speed of said first motor.

3. A processing apparatus for processing yarn from a source comprising:

at least one feed roll for engaging and pulling the yarn from the source and feeding the yarn at a feed rate;

a feed motor for rotatably driving said feed roll;

a yarn processor for receiving the yarn from said feed roll and processing the yarn to produce a desired effect;

a wind roll for engaging and pulling the processed yarn at a wind rate;

a wind motor for rotatably driving said wind roll independently from said feed roll;

a feed rate sensor for monitoring the feed rate of said feed roll;

a wind rate sensor for monitoring the wind rate of said wind roll;

a precision fixed voltage source for selectively producing first and second control voltages;

a switch connected to receive and switch between the first and second control voltages;

an acceleration/deceleration circuit connected to said switch which produces a linear ramp when said switch changes between said first and second voltages, said linear ramp signal having a constant linear rate of voltage change between said first and second control voltages;

a voltage-to-frequency converter connected to said acceleration/deceleration circuit to selectively receive one of said first and second control voltages for producing a control frequency at a frequency corresponding to one of said first and second control voltages and said linear ramp signal;

a feed frequency-to-voltage converter for receiving said control frequency and for producing a feed control voltage corresponding to said control frequency;

a feed D.C. drive connected to receive the feed control voltage and for driving said feed motor at a speed corresponding to said feed control voltage;

a wind frequency-to-voltage converter for receiving said control frequency and for producing a wind control voltage corresponding to said control frequency; and a wind D.C. drive connected to receive the wind control voltage for driving said wind motor at a speed corresponding to said delivery control voltage.

4. A processing apparatus for processing yarn from a source comprising:

a yarn processor for receiving the yarn from the source and processing the yarn to achieve a desired effect;

at least one delivery roll for engaging and pulling the yarn from said processor at a delivery rate;

a delivery motor for rotatably driving said delivery roll independently;

a wind roll for engaging and pulling the yarn from said delivery roll at a wind rate;

a wind motor for rotatably driving said wind roll independently from said delivery roll;

a delivery rate sensor for monitoring the delivery rate of said delivery roll;

a wind rate sensor for monitoring the wind rate of said wind roll;

a precision fixed voltage source for selectively producing first and second control voltages;

a switch connected to receive and switch between the first and second control voltages;

an acceleration/deceleration circuit connected to said switch which produces a linear ramp when said switch changes between said first and second voltages, said linear ramp signal having a constant linear rate of voltage change between said first and second control voltages;

a voltage-to-frequency converter connected to said acceleration/deceleration circuit to selectively receive one of said first and second control voltages for producing a control frequency at a frequency corresponding to one of said first and second control voltages and said linear ramp signal;

a delivery frequency-to-voltage converter for receiving said control frequency and for producing a delivery control voltage corresponding to said control frequency;

a delivery D.C. drive connected to receive the delivery control voltage for driving said delivery motor at a speed corresponding to said delivery control voltage;

a wind frequency-to-voltage converter for receiving said control frequency and for producing a wind control voltage corresponding to said control frequency; and a wind D.C. drive connected to receive the wind control voltage for driving said wind motor at a speed corresponding to said delivery control voltage.

5. An air processing apparatus for air entangling at least one strand of yarn from a source comprising:

at least a first roll for engaging and pulling the yarn from the source at a first rate;

means for guiding the strands of yarn into a side by side relationship on the first roll;

first motive means for rotatably driving and said first roll;

an air entangler for receiving and air entangling the strands of yarn with a high pressure air stream;

at least one second roll for engaging and pulling the yarn at a second rate;

second motive means for rotatably driving said second roll independently from said first roll;

sensor means for sensing speed information of the first and second rates;

output means for outputting the speed information and for outputting a ratio signal corresponding to the ratio of the first rate to the second rate;

control means for independently controlling said first and second motive means to independently vary the first and second rates and, thus, the speed information, whereby the speed information is used to vary the first and second rates to produce a desired effect on the yarn.

* * * * *

UNITED STATES PATENT AND TRADEMARK OFFICE

CERTIFICATE OF CORRECTION

PATENT NO. : 4,782,565

DATED : November 8, 1988

INVENTOR(S) : Richard W. Sheenan et al

It is certified that error appears in the above-identified patent and that said Letters Patent is hereby corrected as shown below:

Column 1, line 59 "mena" should be --mean--;

Column 2, line 7 "lenght" should be --length--;

Column 2, line 67 after "tensioner" insert --to selectively tension the yarn and release tension--;

Column 7, line 14 "embodiement" should be --embodiment--.

Signed and Sealed this

Sixth Day of June, 1989

*Attest:*

DONALD J. QUIGG

*Attesting Officer*

*Commissioner of Patents and Trademarks*